US010975458B2

(12) United States Patent
Park

(10) Patent No.: US 10,975,458 B2
(45) Date of Patent: Apr. 13, 2021

(54) HIGH-STRENGTH GRAY CAST IRON

(71) Applicants: Hyundai Motor Company, Seoul (KR); Kia Motors Corporation, Seoul (KR)

(72) Inventor: Hun Young Park, Ulsan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 304 days.

(21) Appl. No.: 15/978,331

(22) Filed: May 14, 2018

(65) Prior Publication Data

US 2019/0177821 A1 Jun. 13, 2019

(30) Foreign Application Priority Data

Dec. 8, 2017 (KR) ..... 10-2017-0168702

(51) Int. Cl.

| | |
|---|---|
| ***C22C 37/10*** | (2006.01) |
| ***C22C 37/08*** | (2006.01) |
| ***C22C 37/06*** | (2006.01) |
| ***C22C 33/08*** | (2006.01) |

(52) U.S. Cl.

CPC ..... *C22C 37/10* (2013.01); *C22C 33/08* (2013.01); *C22C 37/06* (2013.01); *C22C 37/08* (2013.01)

(58) Field of Classification Search

CPC ..... C22C 37/06; C22C 37/08; C22C 37/10; C22C 33/08; C22C 37/04; C22C 38/34; C22C 38/36

See application file for complete search history.

(56) References Cited

U.S. PATENT DOCUMENTS

| | | | | | |
|---|---|---|---|---|---|
| 5,837,069 | A * | 11/1998 | Deards | C21D 5/00 | 148/323 |
| 6,053,990 | A * | 4/2000 | Persson | C22C 37/10 | 148/321 |
| 2008/0206584 | A1* | 8/2008 | Jaszarowski | C22C 37/10 | 428/544 |
| 2016/0108503 | A1* | 4/2016 | Nam | C22C 37/06 | 420/15 |

FOREIGN PATENT DOCUMENTS

| | | | |
|---|---|---|---|
| CN | 103993216 | A * | 8/2014 |
| DE | 3146120 | A1 * | 7/1982 |
| JP | 2005036693 | A * | 5/2005 |
| KR | 20040037961 | A | 5/2004 |
| KR | 20100031131 | A | 3/2010 |
| KR | 10-1214709 | B1 | 12/2012 |

* cited by examiner

*Primary Examiner* — Anthony J Zimmer
*Assistant Examiner* — Dean Mazzola
(74) *Attorney, Agent, or Firm* — Mintz Levin Cohn Ferris Glovsky and Popeo, P.C.; Peter F. Corless

(57) ABSTRACT

Disclosed herein is a gray cast iron having high strength and reduced casting defects. The high-strength gray cast iron may include: an amount of about 3.10 to 3.50 wt % of carbon (C), an amount of about 2.10 to 2.40 wt % of silicon (Si), an amount of about 0.50 to 0.80 wt % of manganese (Mn), an amount less than or equal to about 0.10 wt % (not including 0%) of phosphorus (P), an amount less than or equal to about 0.10 wt % (not including 0%) of sulfur (S), an amount of about 0.25 to 0.45 wt % of chromium (Cr), an amount of about 1.00 to 1.40 wt % of copper (Cu), an amount less than or equal to about 0.20 wt % (not including 0%) of nickel (Ni), and a balance of iron (Fe), all the wt % are based on the total weight of the gray cast iron. In particular, the gray cast iron may include a carbon equivalent (CEQ) of about 3.95 to 4.1% calculated by the Equation 1.

8 Claims, 2 Drawing Sheets

| note | COMPARATIVE EXAMPLE 1 | EXAMPLE |
|---|---|---|
| Image (x200) |  |   |
| Cr CARBIDE RATIO | - | 1 ~ 2% |

HIGH-STRENGTH GRAY CAST IRON

CROSS REFERENCE TO RELATED APPLICATION

The present application claims priority of Korean Patent Application No. 10-2017-0168702 filed on Dec. 8, 2017, the entire contents of which is incorporated herein for all purposes by this reference.

TECHNICAL FIELD

The present invention relates to a gray cast iron. In particular, the gray case iron may have high-strength and reduced casting defects.

BACKGROUND OF THE INVENTION

Gray cast iron is a material that is widely used for components of vehicle internal combustion engines since it is relatively inexpensive and has high performance. The gray cast iron is used in combination with various elements at an appropriate ratio due to the interrelation between physical properties such as tensile strength and fatigue strength, costs, and productivity such as machinability of materials in use.

Since FC250, conventional 250 MPa general-purpose gray cast iron, has a relatively high carbon equivalent to cause excessive growth of graphite, it is difficult to have high strength.

Accordingly, there has been proposed and used a high-strength gray cast iron having enhanced strength by reducing the carbon equivalent of the gray cast iron to refine graphite and adding an alloying element such as Cu to the gray cast iron to refine pearlite, in recent years. However, this gray cast iron is rapidly solidified after casting due to a low carbon equivalent, and for this reason, there is a problem in that many casting defects occur due to poor discharge of gas.

In addition, in general-purpose gray cast iron such as CGI400, the reinforced high strength of the gray cast iron is achieved through spheroidizing of some graphite. However, this gray cast iron is problematic in that machinability is deteriorated due to an increase in ferrite structure and a heat transfer rate is lowered due to spheroidizing of some graphite, resulting in a reduction in heat fatigue life.

SUMMARY OF THE INVENTION

In preferred aspects, the present invention provides a high-strength gray cast iron having high strength and reduced casting defects by optimally adjusting an alloying element content of the gray cast iron and controlling a carbon equivalent of the gray cast iron.

In one aspect, provided is a gray cast iron that may include: an amount of about 3.10 to 3.50 wt % of carbon (C), an amount of about 2.10 to 2.40 wt % of silicon (Si), an amount of about 0.50 to 0.80 wt % of manganese (Mn), an amount less than or equal to about 0.10 wt % (not including 0%) of phosphorus (P), an amount less than or equal to about 0.10 wt % (not including 0%) of sulfur (S), an amount of about 0.25 to 0.45 wt % of chromium (Cr), an amount of about 1.00 to 1.40 wt % of copper (Cu), an amount less than or equal to about 0.20 wt % (not including 0%) of nickel (Ni), and a balance of iron (Fe). All the wt % are based on the total weight of the gray case iron. wherein the gray cast iron has a carbon equivalent (CEQ) of 3.95 to 4.1% calculated by the following equation 1:

$$\text{Carbon equivalent (CEQ)} = C + \tfrac{1}{3}(Si+P). \quad \text{[Equation 1]}$$

In Equation 1, each of C, Si, and P represent an element content (wt %).

The gray cast iron may further comprises an amount less than or equal to about 0.10 wt % of molybdenum (Mo).

The gray cast iron may essentially consist of, consist essentially of, or consist of the components as described herein. For instance, the gray cast iron may essentially consist of, consist essentially of, or consist of: an amount of about 3.10 to 3.50 wt % of carbon (C); an amount of about 2.10 to 2.40 wt % of silicon (Si); an amount of about 0.50 to 0.80 wt % of manganese (Mn); an amount less than or equal to about 0.10 wt % (not including 0%) of phosphorus (P); an amount less than or equal to about 0.10 wt % (not including 0%) of sulfur (S); an amount of about 0.25 to 0.45 wt % of chromium (Cr); an amount of about 1.00 to 1.40 wt % of copper (Cu); an amount less than or equal to about 0.20 wt % (not including 0%) of nickel (Ni); and a balance of iron (Fe). Moreover, the gray cast iron may essentially consist of, consist essentially of, or consist of: an amount of about 3.10 to 3.50 wt % of carbon (C); an amount of about 2.10 to 2.40 wt % of silicon (Si); an amount of about 0.50 to 0.80 wt % of manganese (Mn); an amount less than or equal to about 0.10 wt % (not including 0%) of phosphorus (P); an amount less than or equal to about 0.10 wt % (not including 0%) of sulfur (S); an amount of about 0.25 to 0.45 wt % of chromium (Cr); an amount of about 1.00 to 1.40 wt % of copper (Cu); an amount less than or equal to about 0.20 wt % (not including 0%) of nickel (Ni); an amount less than or equal to about 0.10 wt % of molybdenum (Mo); and a balance of iron (Fe).

The gray cast iron may have a solidification temperature of about 1175 to 1185° C.

The gray cast iron may be formed with pearlite and ferrite and may have a ferrite fraction of less than about 1%.

The gray cast iron may have a tensile strength of greater than or equal to about 300 MPa.

The gray cast iron may have a hardness of about 200 to 260 HB.

The gray cast iron may have a thermal conductivity of more than or equal to about 45 W/mK.

A chromium carbide may be precipitated from the gray cast iron.

The chromium carbide may be precipitated at a ratio of about 1 to 2% from the gray cast iron.

Further provided is a vehicle part that may include the gray cast iron as described herein. The vehicle part may suitably be an engine, or other component of a vehicle.

Still further provided is a vehicle including the vehicle part described herein.

According to the present application, a difference between the pouring temperature and the solidification temperature of molten steel may increase during casting by controlling the carbon equivalent of the gray cast iron and the solidification temperature of the molten steel may be reduced, compared to a conventional gray case iron in the related art. Thus, casting defects may be suppressed by providing a time sufficient to discharge gas when the molten steel is solidified.

In addition, the gray case iron may have tensile strength greater than 300 MPa by controlling the amounts of alloying elements such as Cr and Cu.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
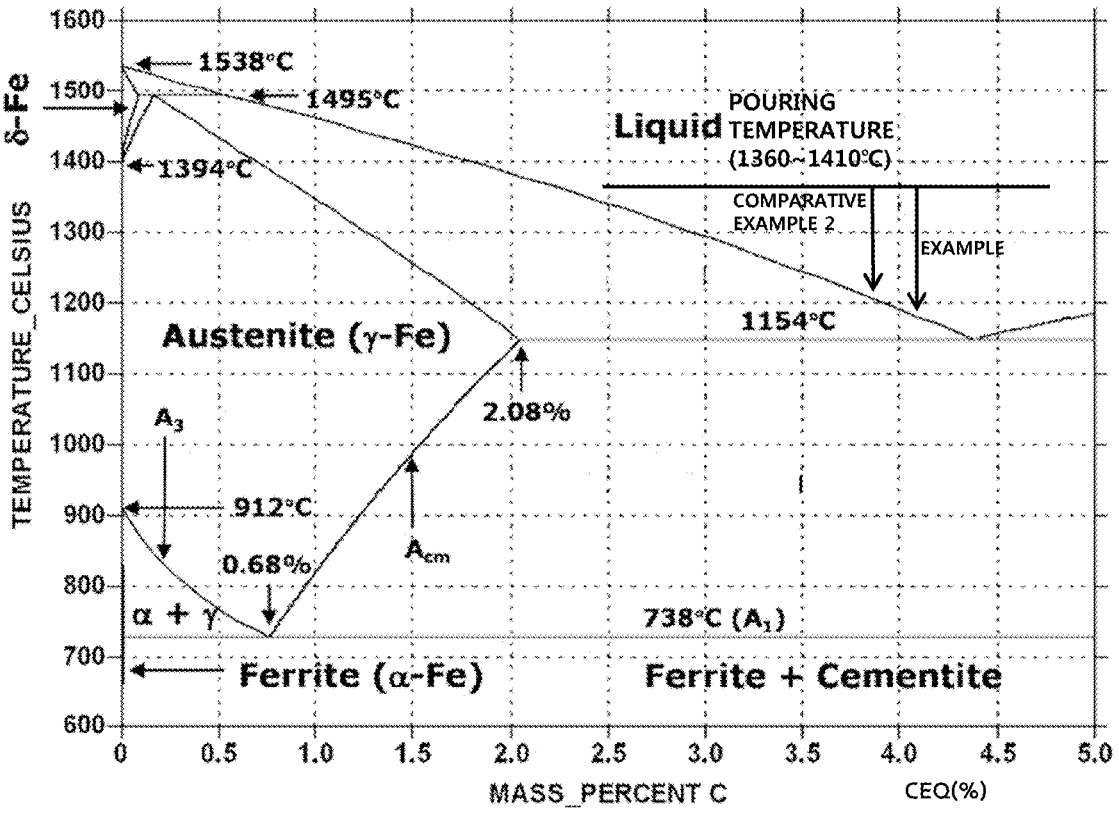
FIG. 1 is an Fe—C phase diagram illustrating a change in solidification temperature depending on a carbon equivalent.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

An embodiment of the present invention relates to a high-strength gray cast iron that is used for components of vehicle internal combustion engines. The gray case iron may have high strength and prevent casting defects.

In one aspect, the gray cast iron may include: an amount of about 3.10 to 3.50 wt % of carbon (C), an amount of about 2.10 to 2.40 wt % of silicon (Si), an amount of about 0.50 to 0.80 wt % of manganese (Mn), an amount less than or equal to about 0.10 wt % (not including 0%) of phosphorus (P), an amount less than or equal to about 0.10 wt % (not including 0%) of sulfur (S), an amount of about 0.25 to 0.45 wt % of chromium (Cr), an amount of about 1.00 to 1.40 wt % of copper (Cu), an amount less than or equal to about 0.20 wt % (not including 0%) of nickel (Ni), and a balance of iron (Fe). All the wt % are based on the total weight of the gray cast iron. The high-strength gray cast iron may further include an amount less than or equal to about 0.10 wt % of molybdenum (Mo).

In the embodiment of the present invention, the reason that alloying elements and their compositions are limited will be described below. Hereinafter, the unit "%" of the composition means wt %, unless context clearly indicates otherwise.

Preferably, the gray cast iron includes an amount of about 3.10 to 3.50 wt % of carbon (C) based on the total weight of the gray case iron.

The carbon (C) as used herein may be an element of FC250, which is conventional general-purpose gray cast iron, for casting fluidity and smooth discharge of gas. Thus, the carbon content may be preferably included in an amount of about 3.10 to 3.50 wt %.

Preferably, the gray cast iron may include an amount of about 2.10 to 2.40 wt % of silicon (Si). The silicon (Si) as used herein may be an element added to control castability and strength and a primary element for determining a carbon equivalent. The silicon content may preferably be equal to or greater than about 2.10% for securing castability and strength. When the silicon is excessively added to the gray cast iron, graphite may excessively grow due to high crystallization of graphite. Therefore, the silicon content may preferably be included in an amount of about 2.10 to 2.40 wt %.

Preferably, the gray cast iron may include in an amount of about 0.50 to 0.80 wt % of manganese (Mn) based on the total weight of the gray case iron.

The manganese (Mn) as used herein may be an element that is distributed in a structure and serves to enhance strength through stabilization of pearlite as a matrix structure. Thus, the manganese content may preferably be equal to or greater than about 0.05% for securing strength. On the other hand, when greater than about 0.80% of Mn is added to the gray cast iron, the strength of the gray cast iron may be increased but the formation of graphite therein may be frustrated and graphite fraction as a heat transfer factor may be reduced, thereby causing a reduction in thermal conductivity. The reduction in thermal conductivity may cause a reduction in heat fatigue life and adversely affects durability. Therefore, the manganese content may preferably be included in an amount of about 0.50 to 0.80 wt %.

Preferably, the gray cast iron may include an amount less than or equal to about 0.10 wt % (not including 0%) of phosphorus (P) based on the total weight of the gray case iron. When the phosphorus (P) content is greater than about 0.10 wt %, the elongation percentage of the gray cast iron may be reduced due to the increase of impurities of material.

Preferably, the gray cast iron may include an amount less than or equal to about 0.10 wt % (not including 0%) of sulfur (S) based on the total weight of the gray case iron. When the sulfur (S) content is greater than about 0.10 wt %, the corrosion resistance and machinability of the gray cast iron may be deteriorated. Preferably, the gray cast iron may include an amount of about 0.25 to 0.45 wt % of chromium (Cr) based on the total weight of the gray case iron.

The chromium (Cr) as used herein may be an element that contributes to enhancement of strength by precipitating Cr carbide during casting. Thus, the chromium content may preferably be equal to or greater than about 0.25 wt % for securing strength. On the other hand, when the Cr content is greater than about 0.45 wt % in the gray cast iron, the machinability of the gray cast iron may be deteriorated and it may cost too much.

Preferably, the gray cast iron may include an amount of about 1.00 to 1.40 wt % of copper (Cu) based on the total weight of the gray case iron. The copper (Cu) as used herein may be an element that promotes the formation of pearlite and refines and stabilizes pearlite. The copper content may preferably be equal to or greater than about 1.00 wt % for the stable formation of pearlite. However, when the content of Cu is greater than about 1.40 wt % in the gray cast iron, the machinability of the gray cast iron may be deteriorated.

Preferably, the gray cast iron may include an amount less than or equal to about 0.20 wt % (not including 0%) of nickel (Ni) based on the total weight of the gray case iron. The nickel (Ni) as used herein may be an element that enhances corrosion resistance. However, when the excessive amount of nickel is added to the gray cast iron, the cost may increase, so the nickel content may preferably be less than or equal to about 0.20 wt %.

Preferably, the gray cast iron may include an amount less than or equal to about 0.10 wt % of molybdenum (Mo) based on the total weight of the gray case iron. The molybdenum (Mo) as used herein may be an element that enhances corrosion resistance. However, when the excessive amount of molybdenum is added to the gray cast iron, the cost may increase, so the molybdenum content may preferably be less than or equal to about 0.10 wt %.

The gray cast iron according to an exemplary embodiment of the present invention may have a carbon equivalent (CEQ) of about 3.95 to 4.1% calculated by the following equation 1:

$$\text{Carbon equivalent (CEQ)} = C + \tfrac{1}{3}(Si + P), \qquad \text{[Equation 1]}$$

where each of C, Si, and P represents an element content (wt %).

The carbon equivalent (CEQ) may be a major factor for determining the solidification temperature of molten steel. The molten steel may be heated to a predetermined temperature until it is poured and then solidified during casting in order to smoothly discharge gas from the molten steel and prevent casting defects. Thus, the carbon equivalent (CEQ) may preferably be limited to equal to or greater than 3.95%. However, when the carbon equivalent (CEQ) is greater than about 4.1%, the strength of the gray cast iron may be decreased due to the excessive growth of graphite. Therefore, the carbon equivalent (CEQ) may preferably be limited to about 3.95 to 4.1%. In certain aspects, the carbon equivalent (CEQ) preferably may be 3.96% to 3.9% or 4.0%, or 3.97% to 3.9% or 4.0%.

The gray cast iron may include the balance of iron (Fe) and unavoidable impurities.

Hereinafter, the present invention will be described with reference to comparative examples and an example.

Experiments were performed on the production of a final product according to the production condition of commercial available gray cast iron. The product was produced by casting using molten steel and the compositions of the molten steel are shown in the following Table 1.

TABLE 1

| Sort | C | Si | Mn | P | S | Cr | Cu | Ni | Sn | CEQ |
|---|---|---|---|---|---|---|---|---|---|---|
| Example | 3.3 | 2.2 | 0.68 | 0.04 | 0.05 | 0.4 | 1.2 | 0.01 | — | 4.05 |
| Comp Ex. 1 | 3.48 | 1.94 | 0.66 | 0.033 | 0.026 | 0.2 | 0.44 | — | — | 4.14 |
| Comp Ex. 2 | 3.1 | 2.36 | 0.85 | 0.05 | 0.06 | 0.06 | 0.83 | — | 0.035 | 3.90 |
| Comp Ex. 3 | 3.3 | 2.3 | 1.4 | 0.04 | 0.06 | 0.1 | 0.51 | — | — | 4.08 |
| Comp Ex. 4 | 3.69 | 2.03 | 0.21 | 0.031 | 0.007 | 0.02 | 0.87 | — | 0.011 | 4.38 |

In Table 1, the carbon equivalent (CEQ) was calculated by the above equation 1.

The solidification temperature, ferrite ratio, tensile strength, hardness, and thermal conductivity of the produced product were measured, and their results are indicated in the following Table 2.

The solidification temperature was measured with reference to the Fe—C phase diagram of FIG. 1 and the carbon equivalent of Table 1.

The ferrite ratio was evaluated according to ASTM A247.

The tensile strength was evaluated according to KS B 0802 (tensile test method of metallic material) using a test specimen 8 manufactured according to KS B 0801 (tensile test specimen of metallic material).

The hardness was measured according to KS B 0805 (Brinell hardness test method of metallic material).

TABLE 2

| Sort | Solidification temperature (° C.) | Ferrite ratio (%) | Tensile strength (MPa) | Hardness (HB) | Thermal conductivity (W/mK) |
|---|---|---|---|---|---|
| Example | 1180 | less than 1% | 334 | 238 | 47.2 |
| Comp Ex. 1 | 1170 | less than 1% | 278 | 194 | 49.4 |
| Comp Ex. 2 | 1210 | less than 1% | 304 | 235 | not measured |
| Comp Ex. 3 | 1178 | less than 1% | 341 | 243 | 42.7 |
| Comp Ex. 4 | 1155 | 3.70% | 517 | 249 | 31.1 |

FIG. 1 is a Fe—C phase diagram illustrating a change in solidification temperature depending on the carbon equivalent. As seen in FIG. 1 and Table 2, the carbon equivalent in the example was greater than that in the comparative example 1 when comparing the carbon equivalents in the example and the comparative example 2. As illustrated in FIG. 1, the high carbon equivalent within the range of the carbon equivalent in the example and the comparative example 1 results in a relatively low solidification temperature. Accordingly, on the basis of the pouring temperature of 1390° C. of molten steel in casting, the molten steel was cooled and then solidified at a temperature of 210° C. in the example whereas it was cooled and then solidified at a temperature of 180° C. in the comparative example 2. Thus, the molten steel had a higher solidification temperature by about 17% during casting in the example, compared to the comparative example 2. The solidification temperature may be directly associated with castability. Therefore, the increase in solidification temperature may allow gas to be smoothly discharged after the molten steel is poured, thereby preventing casting defects.

Meanwhile, the gray cast iron in the example of the present invention satisfies the element content and carbon equivalent indicated above. Therefore, the gray cast iron in the example of the present invention satisfies a solidification temperature of about 1175 to 1185° C., a tensile strength of greater than or equal to about 300 MPa, a hardness of about 200 to 260 HB, and a thermal conductivity of greater than or equal to about 45 W/mK. Particularly, in the example, the tensile strength and the hardness were kept high by virtue of the stabilization of pearlite due to an increase in Cu content and the precipitation of Cr carbide due to an increase in Cr content, without spheroidizing of graphite by addition of Mg. In addition, the gray cast iron had substantially the same thermal conductivity and ferrite ratio (less than 1%) as general-purpose gray cast iron, and thus the machinability thereof may be secured. The tensile strength in the example may be improved by greater than 20%, compared to that in the comparative example 1, by optimizing the amounts of Cr and Cu.

Figure 2:
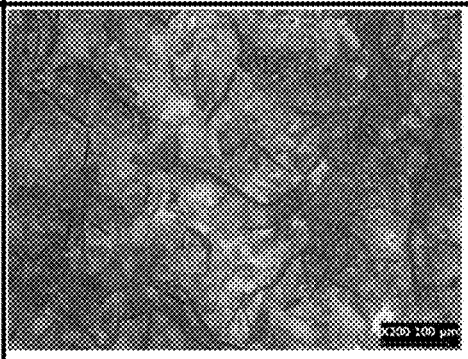
FIG. 2 is an SEM photograph illustrating a fine structure of an example and a comparative example 1.
Figure 2:
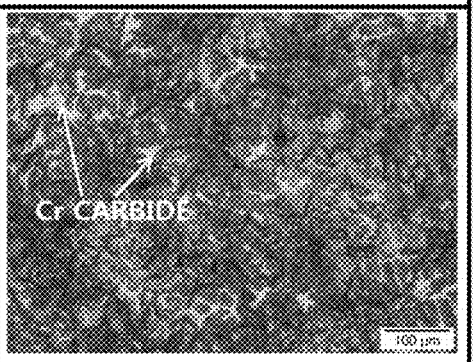

Meanwhile, FIG. 2 is an SEM photograph illustrating a fine structure according to the example and the comparative example 1. When comparing the example with the comparative example 1, the Cr carbide was precipitated at a ratio of 1 to 2% in the example whereas no Cr carbide was precipitated in the comparative example 1.

Accordingly, the improvement in tensile strength by greater than 20% in the example compared to the comparative example 1 may allow the amount of Cu as a pearlite stabilization element to be increased, thereby obtaining a minute pearlite matrix structure. In addition, since the Cr carbide may be precipitated through the optimization of the Cr content, the gray cast iron may have high strength.

On the other hand, FC 250, conventional general-purpose gray cast iron, may not secure tensile strength and hardness due to the lack of Cr and Cu in the comparative example 1.

In the comparative example 2, the carbon equivalent may be reduced and the graphite may be refined so that the tensile strength and the hardness may be improved, compared to the comparative example 1. However, the gray cast iron may be rapidly solidified during casting, as described above, in the comparative example 2, compared to the example. Hence, a large blow hole may remain in the material due to no discharge of gas therefrom. This may cause a fatal defect in the final product.

In the comparative example 3, cast iron with a high Mn content may have improved strength through stabilization and robustness of pearlite as a matrix structure by increasing an amount of Mn. However, since the Mn frustrates the formation of graphite, it adversely may affect graphite fraction as a major heat transfer factor and causes a reduction in thermal conductivity. In the comparative example 3, the thermal conductivity was reduced by about 11%, compared to the example.

Although the tensile strength may be significantly improved by spheroidizing graphite by virtue of the addition of Mg in the comparative example 4, the machinability of the cast iron may be remarkably decreased due to an increase in ferrite ratio. In addition, the thermal conductivity may be reduced due to the spheroidized graphite.

Although the various preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A gray cast iron, having a composition consisting of:

an amount of 3.10 to 3.50 wt % of carbon (C), an amount of 2.10 to 2.40 wt % of silicon (Si), an amount of 0.50 to 0.80 wt % of manganese (Mn), an amount of more than 0 wt % and less than or equal to 0.10 wt % of phosphorous (P), an amount of more than 0 wt % and less than or equal to 0.10 wt % of sulfur (S), an amount of 0.25 to 0.45 wt % of chromium (Cr), an amount of 1.00 to 1.40 wt % of copper (Cu), an amount of more than 0 wt % and less than or equal to 0.20 wt % of nickel (Ni), an amount of less than or equal to 0.10 wt % of molybdenum (Mo), and a balance of iron (Fe), all the wt % are based on the total weight of the gray cast iron, wherein the gray cast iron has a carbon equivalent (CEQ) of 3.95 to 4.1% calculated by the following equation 1:

$$\text{Carbon equivalent (CEQ)}=C+1/3(Si+P), \quad \text{[Equation 1]}$$

where each of C, Si, and P in the Equation 1 represents an element content (wt %), wherein the gray cast iron has a tensile strength of greater than or equal to 300 MPa, wherein the gray cast iron has a hardness of 200 to 260 HB, wherein the gray cast iron has a thermal conductivity of greater than or equal to 45 W/mK.

2. The gray cast iron according to claim 1, wherein the gray cast iron has a solidification temperature of 1175 to 1185° C.

3. The gray cast iron according to claim 1, wherein the gray cast iron has pearlite and ferrite and has a ferrite fraction of less than 1%.

4. The gray cast iron according to claim 1, wherein the gray cast iron has a chromium carbide.

5. The gray cast iron according to claim 4, wherein the gray cast iron has the chromium carbide 1 to 2 wt %.

6. A vehicle part comprising a gray cast iron of claim 1.

7. The vehicle part of claim 6, wherein the vehicle part is an engine.

8. A vehicle comprising a vehicle part of claim 6.

* * * * *